US006561924B2

(12) United States Patent
Ogg

(10) Patent No.: US 6,561,924 B2
(45) Date of Patent: May 13, 2003

(54) FOUR PIECE GOLF BALL

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/063,484

(22) Filed: Apr. 29, 2002

(65) Prior Publication Data

US 2002/0155901 A1 Oct. 24, 2002

Related U.S. Application Data

(63) Continuation-in-part of application No. 09/527,381, filed on Mar. 16, 2000, now Pat. No. 6,379,266.

(51) Int. Cl.[7] ..... A63B 37/02
(52) U.S. Cl. ..... 473/358
(58) Field of Search ..... 473/356, 357, 473/361, 362, 363, 364, 365, 378, 351

(56) References Cited

U.S. PATENT DOCUMENTS

| | | | | |
|---|---|---|---|---|
| 2,153,409 | A | | 4/1939 | Bogoslowsky |
| 2,973,800 | A | | 3/1961 | Muccino |
| 3,553,159 | A | | 1/1971 | Miller et al. |
| 5,020,803 | A | | 6/1991 | Gendreau et al. |
| 5,273,286 | A | | 12/1993 | Sun |
| 5,334,673 | A | | 8/1994 | Wu |
| 5,542,663 | A | | 8/1996 | Kato et al. |
| 5,674,137 | A | | 10/1997 | Maruko et al. |
| 5,692,974 | A | | 12/1997 | Wu et al. |
| 5,713,801 | A | * | 2/1998 | Aoyama ..... 473/354 |
| 5,716,293 | A | | 2/1998 | Yabuki et al. |
| 5,752,888 | A | | 5/1998 | Maruko et al. |
| 5,772,530 | A | | 6/1998 | Kato |
| 5,797,808 | A | | 8/1998 | Hayashi et al. |
| 5,816,940 | A | | 10/1998 | Hayashi et al. |
| 5,816,941 | A | * | 10/1998 | Hayashi et al. ..... 473/359 |
| 5,816,942 | A | | 10/1998 | Hayashi et al. |
| 5,827,167 | A | * | 10/1998 | Dougan et al. ..... 473/365 |
| 5,836,831 | A | | 11/1998 | Stanton et al. |
| 5,908,358 | A | | 6/1999 | Wu |
| 6,117,024 | A | * | 9/2000 | Dewanjee ..... 473/351 |
| 6,359,066 | B1 | * | 3/2002 | Yabuki ..... 525/71 |
| 6,379,266 | B1 | * | 4/2002 | Ogg et al. ..... 473/358 |
| 6,458,046 | B1 | * | 10/2002 | Halko et al. ..... 473/361 |
| 6,475,417 | B2 | * | 11/2002 | Nesbitt et al. ..... 264/134 |

* cited by examiner

*Primary Examiner*—Steven Wong
*Assistant Examiner*—Raeann Gordon
(74) *Attorney, Agent, or Firm*—Michael A. Catania

(57) ABSTRACT

A four-piece golf ball is disclosed herein. The golf ball has a core with an oxygen barrier boundary layer, a wound layer and a polyurethane cover. The core is preferably composed of polybutadiene material. The boundary layer is preferably composed of a blend of ionomers. The cover is preferably composed of a thermosetting polyurethane material. The golf ball has exceptional distance, exceptional feel and exceptional durability.

5 Claims, 1 Drawing Sheet

FOUR PIECE GOLF BALL

CROSS REFERENCES TO RELATED APPLICATIONS

The Present Application is a continuation-in-part application of U.S. patent application Ser. No. 09/527,381, filed on Mar. 16, 2000, now U.S. Pat. No. 6,379,266.

FEDERAL RESEARCH STATEMENT

[Not Applicable]

BACKGROUND OF INVENTION

1. Field of the Invention

The present invention relates to a multiple layer golf ball. More specifically, the present invention relates to a four-piece golf ball wherein the golf ball has a core, a boundary layer, a wound layer and a cover.

2. Description of the Related Art

Golf balls have evolved throughout the history of the game. The first type of golf balls were the featherie, a leather sphere stuffed with wet, compressed feathers. The next innovation in golf balls was the gutta percha one piece golf ball. As early as the 1800's, golfers realized that gutta percha golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a patent for a golf ball with indentations (dimples) that flew better and more accurately than golf balls with brambles. A.G. Spalding & Bros., purchased the U.S. rights to the patent and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls. The only innovation related to the surface of a golf ball during this sixty year period came from Albert Penfold who invented a mesh-pattern golf ball for Dunlop. This pattern was invented in 1912 and was accepted until the 1930's.

Golf balls with a wound layer appeared in the 1920's, and have been refined since that time. In the 1930's through the 1960's, the major innovations in golf balls related to core development. In the 1960's, the development of ionomer materials, particularly the brand SURLYN® from Du Pont, became the major innovation for golf balls into the 1980's. In the 1970's, dimple pattern innovations also appeared from the major golf ball manufacturers. In 1973, Titleist introduced an icosahedron pattern which divides the golf ball into twenty triangular regions. In the late 1980's and into the 1990's, three-piece solid golf balls, as opposed to three-piece wound, began to appear from the major golf ball manufacturers. These three-piece solid golf balls involved two thermoplastic layers covering a core.

Although not commercialized, several patents have disclosed four-piece golf balls. One example is Sun, U.S. Pat. No. 5,273,286 for a Multiple Concentric Section Golf Ball, which was filed in 1992. Sun discloses a golf ball with a solid inner core, a graphite intermediate core, a polybutadiene outer core and a cover composed of balata, ionomer or urethane materials.

Other examples are Hayashi et al., U.S. Pat. No. 5,816,940 for a Wound Golf Ball, which was originally filed in Japan in 1996, and Hayashi et al., U.S. Pat. No. 5,797,808 for a Wound Golf Ball which was originally filed in Japan in 1996. The Hayashi patents disclose a polybutadiene center core, a thermoplastic enclosure layer (preferably an elastomer), a wound layer and a cover composed of an inner layer and an outer layer with both cover layers composed of thermoplastic materials.

Yet another example is Maruko et al., U.S. Pat. No. 5,674,137 which was originally filed in Japan in 1994. Maruko discloses a golf ball with a liquid filled core, a wound layer over the core, and inner and outer cover layers composed of an ionomer material. The primary objective of Maruko is to provide a golf ball with good distance, well-defined spin and greater durability.

A further example is Yabuki et al., U.S. Pat. No. 5,716,293 for a Golf Ball which was originally filed in Japan in 1995. Yabuki discloses a golf ball with a rubber solid core containing an oil substance, an oil-resistant coating layer, a wound layer and an ionomer cover layer.

Another example is Stanton et al., U.S. Pat. No. 5,836,831 for a Golf Ball, originally filed in 1996. Stanton discloses a liquid filled core having a polyether-amide shell, a wound layer and a polymer cover.

There have been many attempts to develop a golf ball that can do everything for every golfer, a golf ball that has tremendous distance, with exceptional feel and outstanding durability. However, current golf balls have been unable to deliver everything.

SUMMARY OF INVENTION

The present invention provides a golf ball that has tremendous distance, with exceptional feel and outstanding durability. The present invention is able to accomplish this by providing a four-piece wound golf ball with a polyurethane cover.

One aspect of the present invention is a golf ball having a core, a boundary layer, a wound layer and a cover. The solid core is composed of a polybutadiene material and has a distortion of less than 0.138 inch under a constant load of 220 pounds. The core has diameter in the range of 1.35 inches to 1.58 inches. The boundary layer covers the solid core. The boundary layer is composed of a blend of ionomer materials, has a Shore D hardness between 55 and 70 and a thickness in the range of 0.01 inch to 0.1 inch. The wound layer covers the boundary layer and has a thickness of 0.05 inch to 0.1 inch. The cover is composed of a cast thermosetting polyurethane material covering the wound layer. The cast thermosetting polyurethane cover has a thickness in the range of 0.01 inch to 0.05 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION

The novel golf ball of the present invention provides greater distance, better feel, and outstanding durability than present golf balls. The present invention is able to achieve this by providing a four-piece golf ball having a high energy core for distance, a boundary layer to prevent degradation of the core, a wound layer for feel and a polyurethane cover for durability.

Figure 1:
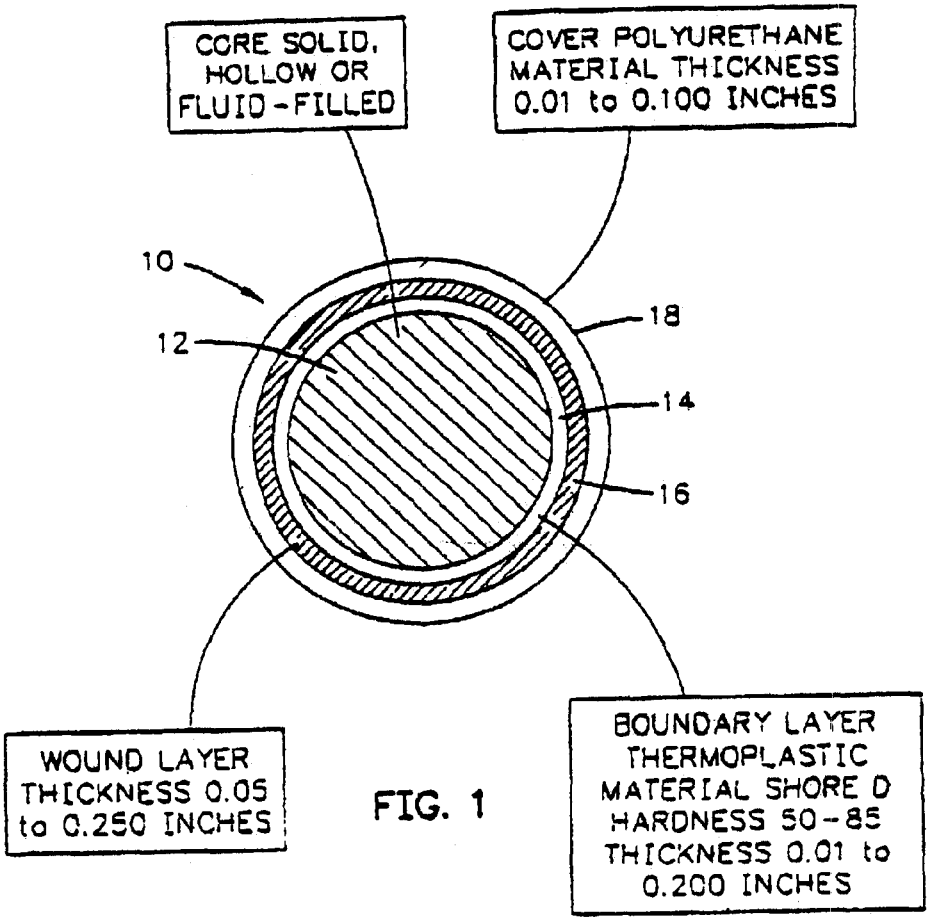
FIG. 1 is a cross-section view of a four-piece golf ball of the present invention.
Figure 2:
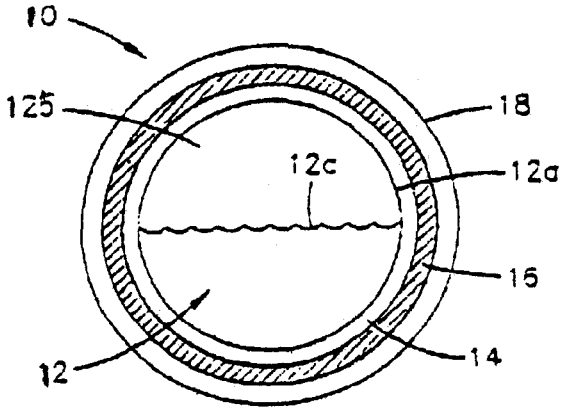
FIG. 2 is a cross-sectional view of an alternative embodiment of a four-piece golf ball of the present invention.

As illustrated in FIG. 1, the golf ball of the present invention is generally indicated as 10. The golf ball 10 includes a solid core 12, a boundary layer 14, a wound layer 16 and a cover 18. Alternatively, as shown in FIG. 2, the golf ball 10 may include a fluid-filled core 12', a boundary layer 14, a wound layer 16, and a cover 18. The boundary layer 14 that covers the core 12 has a predetermined hardness that is softened by the wound layer 16 and the relatively soft cover 18.

The cover 18 is a polyurethane cover that is relatively soft and has a good durability due to the high resilience of the polyurethane material. The polyurethane cover 18 is composed of a polyurethane material preferably formed from a blend of diisocyanate prepolymers. Preferably, the polyurethane is a thermosetting polyurethane, however, thermoplastic polyurethane materials are within the scope of the present invention. The blend of diisocyanate prepolymers includes at least one TDI-based polyurethane prepolymer and at least one other diisocyanate-based polyurethane prepolymer. In a preferred embodiment, the blend of diisocyanate prepolymers includes at least one PPDI-based polyurethane prepolymer and at least one TDI-based polyurethane prepolymer. Alternative embodiments have a blend which includes at least two different PPDI-based polyurethane prepolymer and at least one TDI-based polyurethane prepolymer. Yet further embodiments may include at least one TDI-based polyurethane prepolymer and at least one MDI-based polyurethane prepolymer. Still further embodiments have only a PPDI-based prepolymer instead of a blend of polyurethane prepolymers. Those skilled in the pertinent art will recognize that multiple variations of diisocyanate prepolymers may be utilized without departing from the scope and spirit of the present invention. The cover 18 is described in greater detail below.

The polyurethane cover 18 encompasses the wound layer 16. The wound layer 16 has a thickness in the range of 0.050 inch to 0.250 inch, preferably in the range of 0.060 inch to 0.150 inch and most preferably in the range of 0.080 inch to 0.100 inch. A preferred embodiment has a would layer 16 with a thickness of 0.080 inch.

The wound layer 16 is preferably an elastic fiber having a predetermined modulus of elasticity. A preferred elastic fiber is a rubber thread with a cross section of approximately 0.022 inch×0.0625 inch, and an ultimate elongation of approximately 1000 grams (the thread has a 1000% elongation under a load of 1000 grams). Devices for winding threads around cores are well known in the golf industry. One such apparatus rotates a golf ball core as it draws thread through a tensioning system from a thread source. The tensioning system usually has several tension wheels for applying tension to the thread during winding around the core. The thread is wound around the core to a predetermined diameter. In constructing the golf ball 10 of the present invention, a similar winding device winds the thread around the boundary layer 14 and core 12.

The wound layer 16 provides a softer feel to the golf ball 10, especially with a solid polybutadiene core 12. The wound layer 16 also provides a golf ball 10 with better spin around the greens while not deterring from the distance performance.

The threads of the wound layer 16 encompass a boundary layer 14, as shown in FIGS. 1 and 2. The boundary layer 14 is preferably composed of a thermoplastic material that has a predetermined hardness. A preferred material for the boundary layer 14 is a blend of ionomers such as those sold by DuPont under the brand name SURLYN® or those sold by Exxon Chemical under the brand name IOTEK®. Alternatively, the boundary layer 14 may be composed of a polyether block amide such as PEBAX®, or a polyester elastomer such as HYTREL®. The boundary layer has a Shore D hardness, as measured by ASTM standards, in range of 55 to 70, preferably 60 to 65, and most preferably 62. The boundary layer 14 is described in greater detail below.

The boundary layer 14 encompasses the core 12. As mentioned above, the core 12 may be solid, hollow, or fluid filled with a liquid or gas. A preferred core 12 is a solid core primarily composed of a polybutadiene material. The fluid filled version of the core 12 is preferably filled with a liquid such as corn syrup or water. The core 12 is described in greater detail below. The most important aspect of the present invention is the novel construction of the golf ball 10. The core 12, boundary layer 14, wound layer 16 and cover 18 construction creates a golf ball 10 that has exceptional overall properties, and has the best performance in many if not all pertinent categories. The positioning of a wound layer 16 over a relatively hard boundary layer 14 with a relatively soft and durable cover 18 creates a unique golf ball 10 that has a good feel and delivers tremendous distance.

As mentioned previously, a preferred material for the cover 18 is a thermosetting polyurethane material. The preferred polyurethane is composed of blend of a TDI-based prepolymer, a second diisocyanate-based polyurethane prepolymer and a curing agent. The TDI-based prepolymer is preferably formed from TDI and a polyether polyol. The second diisocyanate-based polyurethane prepolymer is preferably a PPDI-based prepolymer formed from PPDI and a polyester polyol, preferably a polycaprolactone. The prepolymer blend is cured with a curing agent. The curing agent, or curative, may be a diol (e.g., 1,4 butane diol, trimethylpropanol), a mixture of diols (e.g., 1,4 butane diol and ethylene glycol, or other suitable glycols), a hydroquinone, a mixture of hydroquinones, a triol, a mixture of triols, a diamine, a mixture of diamines, an oligomeric diamine, a triamine, or a blend of some or all of these materials. Preferably, the curing agent is a blend of a diamine and a mixture of diols.

In an alternative embodiment, the blend of prepolymers includes three diisocyanate-based polyurethane prepolymers. In this embodiment, the TDI-based prepolymer is preferably formed from TDI and a polyether polyol. The second diisocyanate-based polyurethane prepolymer is preferably a PPDI-based prepolymer formed from PPDI and a polyester polyol, preferably a polycaprolactone. The third diisocyanate-based polyurethane prepolymer is a PPDI-based prepolymer formed from PPDI and a polyether polyol. Preferably, the curing agent is a blend of a diamine and a mixture of diols. As mentioned above, alternative embodiments may have variations of the dual blend or the tri-blend, and may use a TDI-based polyurethane prepolymer with other non-PPDI-based polyurethane prepolymers.

Yet another embodiment of a thermosetting polyurethane cover 18 is one that is composed of a single PPDI-based prepolymer instead of a blend. The PPDI-based polyurethane prepolymer provides a polyurethane with a high rebound at a lower hardness, greater durability and improved sound and feel. The PPDI-based prepolymer is preferably cured with a 1,4 butane diol and ethylene glycol mixture. A preferred single PPDI-based prepolymer is a polycaprolactone terminated prepolymer.

The blending of a TDI-based prepolymer with other diisocyanate-based polyurethane prepolymers lowers the viscosity of the mixture, lowers the temperature of the exothermic reaction that occurs when the prepolymers are reacted with the curing agent, and increases the durability. The TDI-based prepolymer may range from 10 to 40 percent of the polyurethane prepolymer blend. Preferably, the TDI-based prepolymer is 30 percent of the polyurethane prepolymer blend. A preferred TDI based prepolymer is a TDI terminated polyether prepolymer available from Uniroyal Chemical Company of Middlebury, Conn., under the tradename ADIPRENE® LF950.

The dual blend and tri-blend formulations will preferably contain a PPDI terminated polyester prepolymer and/or a PPDI terminated polyether prepolymer. A preferred PPDI terminated polyester prepolymer is available from Uniroyal Chemical under the tradename ADIPRENE® LFPX 2950. A preferred PPDI terminated polyether prepolymer is available from Uniroyal Chemical under the tradename ADIPRENE® LFPX 950.

The polyurethane prepolymer blend may have 10 to 40 parts of a TDI terminated polyether prepolymer blended with 60 to 90 parts of a PPDI terminated polyether prepolymer. Alternatively, the polyurethane prepolymer blend may have 10 to 40 parts of a TDI terminated polyether prepolymer blended with 60 to 90 parts of a PPDI terminated polyester prepolymer. Further, the polyurethane prepolymer blend may have 10 to 40 parts of a TDI terminated polyether prepolymer blended with 5 to 90 parts of a PPDI terminated polyether prepolymer and 5 to 90 parts of a PPDI terminated polyester prepolymer. More specific blend formulations are set forth in the Examples below.

The cover 18 of the golf ball 10 of the present invention is most preferably composed of a polyurethane formed from a polyurethane prepolymer blend composed of a TDI-based polyurethane prepolymer and a PPDI-based polyurethane prepolymer, and cured with a mixture of curing agents such as a diamine and a blend of 1,4 butane diol and glycols. A suitable blend of diol and glycols is available from Uniroyal Chemical under the tradename VIBRACURE® A250. A suitable diamine is toluene ethylene diamine available from Albemarle Corporation of Baton Rouge, La. under the tradename ETHACURE® 100. Other agents which may be utilized during the curing process include dimethylthio-2,4-toluenediamine (such as EHTACURE® 300 available from Albemarle Corporation); trimethyl glycol di-p-aminobenzoate (such as VERSALINK® 740M available from Air Products and Chemicals, Inc., Allentown, Pa.); cyclohexane dimethanol; hydroquinone-bis-hydroxyethyl ether; phenyldiethanol amine mixture (such as VIBRACURE® A931 available from Uniroyal Chemical); methylene dianiline sodium chloride complex (such as CAYTOR® 31 available from Uniroyal Chemical); and/or prionene amine. This list of preferred agents (including chain extenders, cross-linkers and curing agents) is not meant to be exhaustive, as any suitable (preferably polyfunctional) chain extender, cross-linker, or curing agent may be used.

The curing agent mixture for the cover 18 of the present invention may have numerous variations. In a preferred embodiment, the curing agent is composed of 30 to 70 parts of a diol blend such as VIBRACURE® 250 to 70 to 30 parts of a diamine such as ETHACURE® 300. Alternatively, the diamine component may be a blend of different diamines such as a blend of EHTACURE® 100 and ETHACURE® 300.

The ratio of the polyurethane prepolymer blend to curing agent is determined by the nitrogen-carbon-oxygen group (NCO) content of the polyurethane prepolymer blend. For example, the NCO content of the TDI-terminated polyether or TDI-terminated polyester is preferably in the range of 4.0% to 9.0%, while the NCO content of the PPDI-terminated polyether is preferably in the range of 5.0% to 8.0%. The NCO content of the PPDI-terminated polyester is preferably in the range of 2.0% to 6.0%. The NCO content of the polyurethane prepolymer blend ranges from 2% to 8% of the polyurethane prepolymer blend. The amount of curing agent should correspond to 90% to 110% of the mol equivalence of the NCO content of the polyurethane prepolymer blend. The weight ratio of the polyurethane prepolymer blend to the curing agent is preferably in the range of about 10:1 to about 30:1.

Prior to curing, the polyurethane prepolymer blend and curing agent are preferably stored separately. The polyurethane is formed by first heating and mixing the polyurethane prepolymer blend with the curing agent in a mold, and then curing the mixture by applying heat and pressure for a predetermined time period. Additionally, a catalyst (e.g. dibutyl tin dilaurate, a tertiary amine, etc.) may be added to the mixture to expedite the casting process. Specific suitable catalysts include TEDA dissolved in di propylene glycol (such as TEDA L33 available from Witco Corp. Greenwich, Conn., and DABCO 33 LV available from Air Products and Chemicals Inc.,) which may be added in amounts of 2–5%, and more preferably TEDA dissolved in 1,4-butane diol which may be added in amounts of 2–5%. Another suitable catalyst includes a blend of 0.5% 33LV or TEDA L33 (above) with 0.1% dibutyl tin dilaurate (available from Witco Corp. or Air Products and Chemicals, Inc.) which is added to a curative such as VIBRACURE® A250. Further, additives such as colorants may also be added to the mixture.

The polyurethane prepolymer blend material is preferably degassed and warmed in a first holding container prior to processing of the cover 18. The processing temperature for the polyurethane prepolymer blend is preferably in the range of about 100–220° F., and most preferably in the range of about 120–200° F. The polyurethane prepolymer blend is preferably flowable from the first holding container to a mixing chamber in a range of about 200–1100 grams of material per minute, or as needed for processing. In addition, the polyurethane prepolymer blend material may be agitated in the first holding container, in the range of 0–250 rpm, to maintain a more even distribution of material and to eliminate crystallization.

In the preferred embodiment, the curing agent is a blend of a diamine such as ETHACURE® 300 and a 1,4 butane diol and glycol such as VIBRACURE® A250. As previously mentioned, other curatives may also be utilized in forming the cover 18 of the golf ball 10 of the present invention. The curing agent is preferably degassed and warmed in a second holding container prior to processing of the cover 18. The processing temperature for the curative is preferably in the range of about 50–230° F., and most preferably in the range of about 80–200° F. The curing agent is preferably flowable from the second holding container to the mixing chamber in the range of about 15–75 grams of material per minute, or as needed. If a catalyst is used for processing the cover 18, then the catalyst is added to the curing agent in the second holding container to form a curative mixture. Suitable catalyst are described above. The curing agent and catalyst are agitated, in the range of about 0 to 250 rpm, to maintain an even distribution of catalyst in the curative mixture in the second holding container. It is preferred that the catalyst is added in an amount in the range of about 0.25–5% by weight of the combined polyurethane prepolymer blend and curing agent. Additives may be added to the curative mixture as desired. It was discovered that hydrolytic instability of the polyurethane polymer may be avoided by the addition of a stabilizer such as STABOXYL® (available from Rheinchemie, Trenton, N.J.), in amounts of about 0.25–5% of the polyurethane.

The polyurethane prepolymer blend and curative mixture are preferably added to the common mixing chamber at a temperature in the range of about 160–220° F. A colorant material, such as, for example, titanium dioxide, barium sulfate, and/or zinc oxide in a glycol or castor oil carrier, and/or other additive material(s) as are well known in the art, may be added to the common mixing chamber. The amount of colorant material added is preferably in the range of about 0–10% by weight of the combined polyurethane prepolymer blend and curative materials, and more preferably in the range of about 2–8%. Other additives, such as, for example, polymer fillers, metallic fillers, and/or organic and inorganic fillers (e.g. polymers, balata, ionomers, etc.) may be added as well to increase the specific gravity of the polyurethane cover 18 of the present invention. It was discovered that the addition of barytes (barium sulfate) or a blend of barytes and titanium dioxide (preferably added in a carrier glycol and/or castor oil) to the mixture, in the amounts of about 0.01–30%, may add sufficient weight to the polyurethane cover 18. The added weight to the cover 18 allows for the specific gravity of the core 12 to be lowered thereby allowing for an increased resiliency of the core 12. The entire mixture is preferably agitated in the mixing chamber in the range of about 1 to 250 rpm prior to molding. A more detailed explanation of the process is set forth in U.S. Pat. No. 6,200,512, entitled Golf Balls And Methods Of Manufacturing The Same, filed on Apr. 20, 1999, which is hereby incorporated by reference in its entirety.

The coefficient of restitution (COR) is a measure of the resilience of a golf ball. The COR is a measure of the ratio of the relative velocity of the golf ball after direct impact with a hard surface to the relative velocity before impact with the hard surface. The COR may vary from 0 to 1, with 1 equivalent to a completely elastic collision and 0 equivalent to a completely inelastic collision. A golf ball having a COR value closer to 1 will generally correspond to a golf ball having a higher initial velocity and a greater overall distance. The effect of a higher COR value is apparent when a golf club strikes the golf ball 10. The force of the club during a swing is transferred to the golf ball 10. If the golf ball has a high COR (more elastic), then the initial velocity of the golf ball will be greater than if the golf ball had a low COR. In general, a higher compression core will result in a higher COR value.

The core 12 of the golf ball 10 is preferably composed of a blend of a base rubber, a cross-linking agent, a free radical initiator, and one or more fillers or processing aids. A preferred base rubber is a polybutadiene having a cis-1,4 content above 90%, and more preferably 98% or above. A preferred cross-linking agent is a zinc diacrylate, and a commercially available zinc diacrylate is SR-416 from Sartomer Co., Inc., Exton, Pa. Other metal salt di- or mono-(meth)acrylates suitable for use in the present invention include those in which the metal is calcium or magnesium. In the manufacturing process it may be beneficial to pre-mix some cross-linking agent(s), such as, e.g., zinc diacrylate, with the polybutadiene in a master batch prior to blending with other core components.

Free radical initiators are used to promote cross-linking of the base rubber and the cross-linking agent. Suitable free radical initiators for use in the golf ball core 12 of the present invention include peroxides such as dicumyl peroxide, bis-(t-butyl peroxy) diisopropyl benzene, t-butyl perbenzoate, di-t-butyl peroxide, 2,5-dimethyl-2,5-di-5-butylperoxy-hexane, 1,1-di(t-butylperoxy) 3,3,5-trimethyl cyclohexane, and the like, all of which are readily commercially available.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available. A particularly useful tungsten filler is WP102 Tungsten (having a 3 micron particle size) available from Atlantic Equipment Engineers (a division of Micron Metals, Inc.), Bergenfield, N.J.

Table 1 below provides the ranges of materials included in the preferred core formulations of the present invention.

TABLE 1

| Component | Preferred Range | Most Preferred Range |
|---|---|---|
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler | As desired | As desired |
| (e.g. tungsten) | (e.g. 2–10 phr) | (e.g. 2–10 phr) |

In the present invention, the core components are mixed and compression molded in a conventional manner known to those skilled in the art. The finished core 12 has a diameter of about 1.20 to about 1.64 inches for a golf ball 10 having an outer diameter of 1.68 inches. More preferably, the finished core 12 has a diameter of about 1.30 to about 1.50 inches for a golf ball 10 having an outer diameter of 1.68 inches. Most preferably, the finished core 12 has a diameter of about 1.305 to about 1.345 inches for a golf ball 10 having an outer diameter of 1.68 inches The core weight is preferably maintained in the range of about 32 to about 40 g. The core PGA compression is preferably maintained in the range of about 40 to 90, and most preferably about 55 to 80.

As used herein, the term PGA compression is defined as follows: PGA compression value=180 Riehle compression value The Riehle compression value is the amount of deformation of a core or a golf ball in inches under a static load of 200 pounds, multiplied by 1000. Accordingly, for a core deformation (distortion) of 0.110 inch (2.794 millimeters) under a load of 200 pounds (90.8 kilograms), the Riehle compression value is 110 and the PGA compression value is 70.

The core 12 preferably has a distortion of less than 0.138 inch (3.5 millimeters) under a constant load of 220 pounds (100 kilograms). More preferably, the core 12 has a distortion of less than 0.118 inch (3.0 millimeters) under a constant load of 220 pounds.

In an alternative embodiment, the core 12 may be hollow or fluid filled. In such an embodiment, as shown in FIG. 2, the core 12 has a shell 12*a* encompassing an interior chamber 12*b*. The interior chamber may be filled with a fluid 12*c*. Exemplary fluids 12*c* are water, air, corn syrup, oil, and the like. If a liquid is utilized as the fluid 12*c*, then preferably the liquid occupies only half of the volume of the interior chamber 12*b*. The compressibility of the fluid is a primary concern in such an embodiment. The shell 12*a* should be sufficient to contain the fluid under the tremendous forces exerted on the shell 12*a* during impact between a golf club head and the golf ball 10. A preferred shell 12*a* is composed of a polybutadiene material. Alternatively, the shell 12*a* may be composed of metal such as titanium, stainless steel or the like. If the fluid 12*c* is air, the air may be greater or less than one atmosphere in pressure.

As is described above, the present invention includes at least one boundary layer 14 that is preferably composed of a thermoplastic material or a blend of thermoplastic materials. Most preferably the boundary layer 14 is composed of at least one thermoplastic that contains organic chain molecules and metal ions. The metal ion may be, for example, sodium, zinc, magnesium, lithium, potassium, cesium, or any polar metal ion that serves as a reversible cross-linking site and results in high levels of resilience and impact resistance. Suitable commercially available thermoplastics are ionomers based on ethylene copolymers and containing carboxylic acid groups with metal ions such as described above. The acid levels in such suitable ionomers may be neutralized to control resiliency, impact resistance and other like properties. In addition, other fillers with ionomer carriers may be used to modify (e.g. preferably increase) the specific gravity of the thermoplastic blend to control the moment of inertia and other like properties. Exemplary commercially available thermoplastic materials suitable for use in a boundary layer 14 of a golf ball 10 of the present invention include, for example, the following materials and/or blends of the following materials: HYTREL® and/or HYLENE® products from DuPont, Wilmington, Del., PEBAX® products from Elf Atochem, Philadelphia, Pa., SURLYN® products from DuPont, and/or ESCOR® or IOTEK® products from Exxon Chemical, Houston, Tex.

The Shore D hardness of the boundary layer 14 is preferably 75. It is preferred that the boundary layer 14 have a hardness of between about 55–85 Shore D. In a preferred embodiment, the boundary layer 14 has a Shore D hardness in the range of about 65–75. One reason for preferring a boundary layer 14 with a Shore D hardness of approximately 75 is to improve the feel of the resultant golf ball. It is also preferred that the boundary layer 14 is composed of a blend of SURLYN® ionomer resins. SURLYN® 8150, 9150, and 6320 are, respectively, an ionomer resin composed of a sodium neutralized ethylene/methacrylic acid, an ionomer resin composed of a zinc neutralized ethylene/methacrylic acid, and an ionomer resin composed of a terpolymer of ethylene, methacrylic acid and n-butyl acrylate partially neutralized with magnesium, all of which are available from DuPont Polymer Products, Wilmington, Del.

The boundary layer 14 may include a predetermined amount of a baryte mixture. The baryte mixture is included as 8 or 9 parts per hundred parts of the ionomer resins. One preferred baryte mixture is composed of 80% barytes and 20% of an ionomer, and is available from Americhem, Inc., Cuyahoga Falls, Ohio, under the trade designation 38534X1. The Shore D hardness provided in Table 2 below was determined according to ASTM D2240.

Table 2 below sets forth physical data for suitable boundary layers 14 that were manufactured and incorporated into specific examples. As is shown in Table 2 below, each of the boundary layers 14 were composed of an ionomer blend and the specific percentages are provided. The thickness of each of the boundary layers 14 varies from 0.0525 inch and 0.058 inch. The Shore D hardness varies between 58 and 65, however, those skilled in the relevant art will recognize that materials for the boundary layer 14 with higher Shore D hardness values are conventional and within the scope of the invention.

TABLE 2

| Ex. | SURLYN ® | | | Thickness | Shore D |
|---|---|---|---|---|---|
| No. | % 8150 | % 9150 | % 6320 | (inch) | Hardness |
| 1 | 40 | 40 | 20 | 0.058 | 58 |
| 2 | 45 | 45 | 10 | 0.0525 | 62 |
| 3 | 45 | 45 | 10 | 0.0525 | 62 |
| 4 | 40 | 40 | 20 | 0.058 | 60 |
| 5 | 40 | 40 | 20 | 0.058 | 60 |
| 6 | 40 | 40 | 20 | 0.058 | 60 |
| 7 | 45 | 45 | 20 | 0.0525 | 62 |
| 8 | 45 | 45 | 20 | 0.0525 | 62 |
| 9 | 50 | 50 | 0 | 0.0525 | 65 |
| 10 | 45 | 45 | 10 | 0.0525 | 62 |
| 11 | 45 | 45 | 10 | 0.0525 | 62 |
| 12 | 45 | 45 | 10 | 0.0525 | 62 |

TABLE 3

| Ex. | Polyurethane prepolymer | | | | | Thick-ness | Shore D |
|---|---|---|---|---|---|---|---|
| No. | TDI | PPDI-1 | PPDI-2 | PPDI-3 | PPDI-4 | (inch) | Hardness |
| 1 | 30 | 70 | | | | 0.0375 | 47 |
| 2 | 30 | | 20 | 50 | | 0.0300 | 53 |
| 3 | 30 | | | | 70 | 0.0300 | 47 |
| 4 | 30 | | | | 70 | 0.0375 | 47 |
| 5 | 30 | 50 | 20 | | | 0.0375 | 47 |
| 6 | 30 | | | | 70 | 0.0375 | 47 |
| 7 | 30 | 50 | 20 | | | 0.0300 | 47 |
| 8 | 30 | | 20 | 50 | | 0.0300 | 53 |
| 9 | 30 | 70 | | | | 0.0300 | 53 |
| 10 | 20 | 80 | | | | 0.0300 | 47 |
| 11 | 30 | 70 | | | | 0.0300 | 47 |
| 12 | 30 | 70 | | | | 0.0300 | 47 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising:

a solid core having a diameter ranging from 1.46 inches to 1.50 inches, the core having a distortion of less tan 0.138 inch under a constant load of 220 pounds, the solid core comprising cis-polybutadiene, zinc diacrylate in an amount of 25 to 30 parts per one hundred parts of the cis-polybutadiene, zinc oxide in an amount of 5 to 15 parts per one hundred parts of the cis-polybutadiene, zinc stearate in an amount of 1 to 10 parts per one hundred parts of the cis-polybutadiene, peroxide in an amount of 0.5 to 1.5 parts per one hundred parts of the cis-polybutadiene, and tungsten in an amount of 2 to 10 parts per one hundred parts of the cis-polybutadiene;

a boundary layer covering the core, the boundary layer comprising a thermoplastic material having a Shore D hardness between 55 and 70;

a wound layer covering the boundary layer; and a cover comprising a polyurethane material covering the wound layer.

2. The golf ball according to claim 1 wherein the polyurethane layer comprises a cast thermosetting polyurethane material.

3. The golf ball according to claim 1 wherein the cover has a thickness in the range of 0.01 inch to 0.05 inch.

4. The golf ball according to claim 1 wherein the wound layer is wound to a thickness of between 0.080 inch and 0.100 inch.

5. The golf ball according to claim 1 wherein the boundary layer has a thickness of 0.03 inch to 0.10 inch.

* * * * *